US005899340A

United States Patent [19]

MacNaughton

[11] Patent Number: 5,899,340

[45] Date of Patent: May 4, 1999

[54] VIBRATING SCREEN WITH ARCHED FRAME AND BALLAST

[76] Inventor: Douglas J. MacNaughton, P.O. Box 402, Digby, Nova Scotia, BOV 1A0, Canada

[21] Appl. No.: 08/709,770

[22] Filed: Sep. 9, 1996

[51] Int. Cl.[6] ..... B07B 1/34

[52] U.S. Cl. ..... 209/325; 209/420; 209/935

[58] Field of Search ..... 209/310, 311, 209/215, 319, 320, 325, 420, 421, 935

[56] References Cited

U.S. PATENT DOCUMENTS

| | | | |
|---|---|---|---|
| 4,197,194 | 4/1980 | Read . | |
| 4,237,000 | 12/1980 | Read . | |
| 4,699,713 | 10/1987 | Tieben . | |
| 4,923,597 | 5/1990 | Anderson et al. | 209/420 |
| 5,482,165 | 1/1996 | Johnston | 209/935 X |

FOREIGN PATENT DOCUMENTS

| | | | |
|---|---|---|---|
| 2223963 | 4/1990 | United Kingdom | 209/420 |

*Primary Examiner*—Tuan N. Nguyen

*Attorney, Agent, or Firm*—Mario D. Theriault

[57] ABSTRACT

A portable vibrating screen which has an arched frame, a basket supported on top of the arched frame by springs and a rotatable eccentric shaft for imparting a reciprocal movement to the basket. The arched frame has a vertical tall end, a vertical short end and two spaced apart stringer members joining the upper portions of the tall and short ends. The stringer members define an inclined plane between the tall end and the short end. The tall end has a first pair of spaced apart leg members and a first ballast mounted between the leg members of that first pair. The short end has a second pair of leg members and a second ballast mounted between the leg members of that second pair. An amplitude of a vibration of the basket transmitted to the arched frame is largely absorbed by the mass of the first and second ballasts. In another aspect of the present invention, the eccentric shaft has bearings attached to the basket and to the stringer members for retaining the basket along the inclined plane. The stringer members are flexible, within an elastic limit thereof, a sag distance corresponding to at least an offset dimension of the offset shaft. When the basket is filled with a load of screenable material which is larger than a normal load, the eccentric movement of the shaft is partly or entirely absorbed by the deflection of the stringer members.

19 Claims, 6 Drawing Sheets

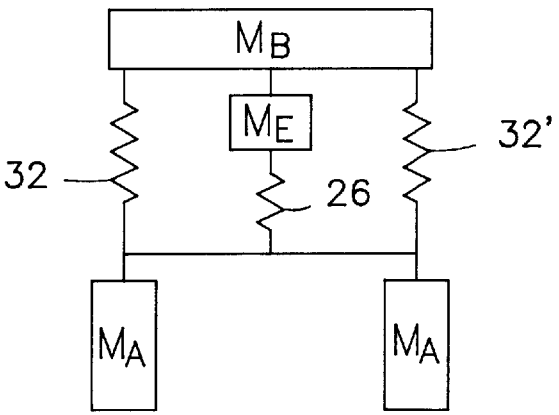
FIG. 9A
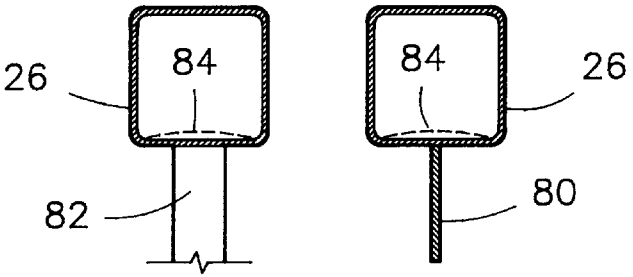
FIG. 7
FIG. 8
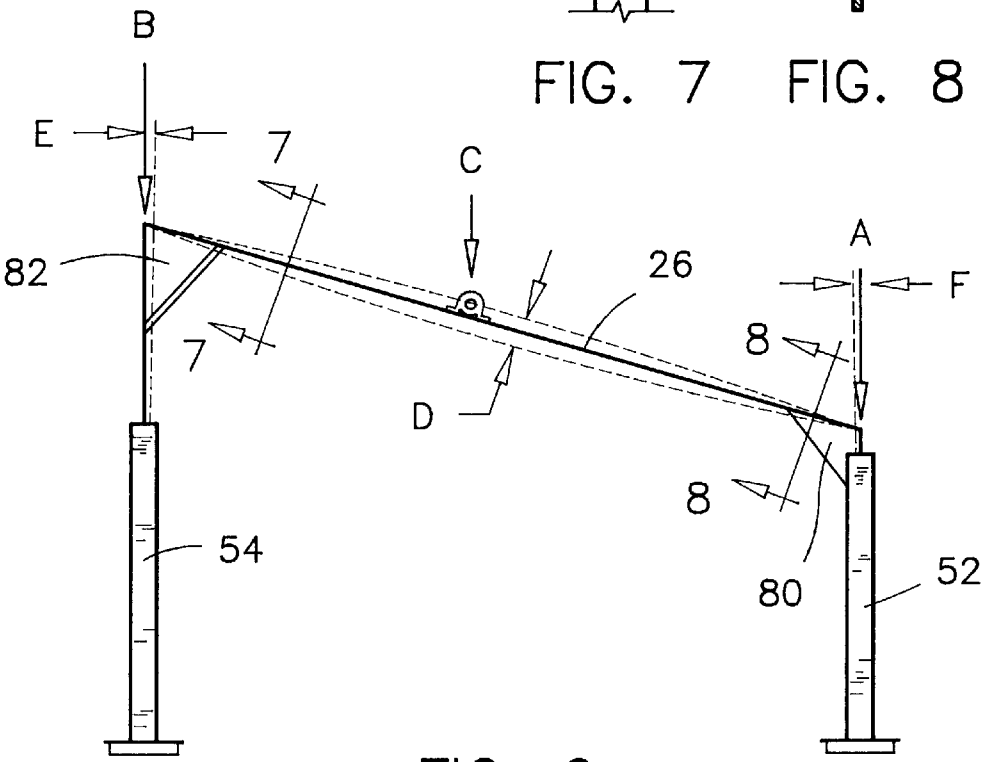
FIG. 9

VIBRATING SCREEN WITH ARCHED FRAME AND BALLAST

FIELD OF THE INVENTION

This invention relates to vibrating screens for separating gravel and the like and more particularly, it relates to a portable vibrating screen having a flexible arched frame with ballast incorporated within the frame.

BACKGROUND OF THE INVENTION

The type of vibrating screens having a particular interest in the present invention is small in size and is normally used by landscape contractors, agricultural facility personnel and small vendors of sand, aggregate and top soil. An example of a vibrating screen of this type is described in U.S. Pat. No. 4,197,194 issued on Apr. 8, 1980 to James L. Read. This portable vibrating screen comprises a box-like frame having a tall end and a short end joined by sides, the short end being closed and the tall end being open. A shaker screen slopes downwardly from the tall end to an upper edge of the short end. The tall end of the frame is open to permit a pay loader to collect the finer material from within the frame.

A common problem with vibrating screens of this type is that the vibration of the screening basket is transmitted to the frame, causing the whole machine to shake and shift on the ground when operating. This shifting of the machine is often referred to in the trade as: "walking". Consequently, users of the machine often add weight to the lower part of the structure by partly burying it with gravel, rocks or cement blocks. However, this additional mass changes the stiffness of the frame and often increases the occurrence of fatigue cracking.

A vibrating screen is by its nature a nonlinear system where the mass carried by the screening basket is continuously changing. Therefore, the equations for finding the natural frequencies or resonance of the structural members, the characteristics of spring isolators and the sizes of mass dampers for such system are nonlinear. Hence, an ideal structure has always been difficult to determine with accuracy, and portable vibrating screens are generally known for requiring frequent tendance by a welder.

SUMMARY OF THE INVENTION

In the present invention, however, there is provided a portable vibrating screen which is stable, durable and safe to operate even when working under demanding conditions.

In one aspect of the present invention, there is provided a vibrating screen comprising broadly of an arched frame supporting a screening basket with a power supply and transmission means for actuating an eccentric shaft and for imparting a reciprocal movement to the basket.

The arched frame of the vibrating screen of the present invention has a vertical tall end, a vertical short end and two spaced apart stringer members joining the upper portions of the tall and short ends. The stringer members define an inclined plane between the tall end and the short end.

The tall end has a first pair of spaced apart leg members and a first ballast mounted between the leg members of that first pair. The short end has a second pair of leg members and a second ballast mounted between the legs members of that second pair.

A first advantage of the vibrating screen of the present invention is that an amplitude of a vibration of the basket transmitted to the arched frame is largely absorbed by the mass of the first and second ballasts. Although the vibrating screen of the present invention is movable as a self-contained unit, it is exceptionally stable on the ground when operating.

In accordance to another aspect of the present invention, the basket has a rectangular frame, a perforated bottom surface and vertical sides for receiving a nominal load of screenable material therein. There is also provided four springs mounted on top of the arched frame for supporting the basket above the inclined plane. The eccentric shaft has bearings attached to the rectangular frame and to the stringer members for retaining the basket along the inclined plane.

The stringer members of the arched frame are flexible, within an elastic limit thereof, a sag distance corresponding to at least an offset dimension of the offset shaft. Therefore, when the basket is filled with a load of screenable material which is larger than the nominal load, the eccentric movement of the shaft is partly or entirely absorbed by the deflection of the stringer members. The arched frame and the basket frame are thereby not subject to detrimental stresses.

The vibrating screen of the present invention is therefore operable with a large variety of screenable materials. It is also operable with minimum consideration for maintenance and repair. The vibrating screen of the present invention is further of a simple construction manufacturable at a reasonable cost. Furthermore, the vibrating screen of the present invention has a low center of gravity whereby it is easily towed behind a vehicle.

BRIEF DESCRIPTION OF THE DRAWINGS

The preferred embodiment of the invention will be further understood from the following description, with reference to the drawings in which:

FIG. 7 is a cross-sectional view of a stringer member and a rear gusset of the portable vibrating screen along line 7—7 in FIGS. 2 and 9;

FIG. 8 is a cross-sectional view of a stringer member and a front gusset of the portable vibrating screen along line 8—8 in FIGS. 2 and 9;

FIG. 9 is a structural schematic of the arched frame of the portable vibrating screen of the preferred embodiment;

FIG. 9A is an analogous schematic diagram of the portable vibrating screen of the preferred embodiment;

DETAILED DESCRIPTION OF THE PREFERRED EMBODIMENT

Figure 1:
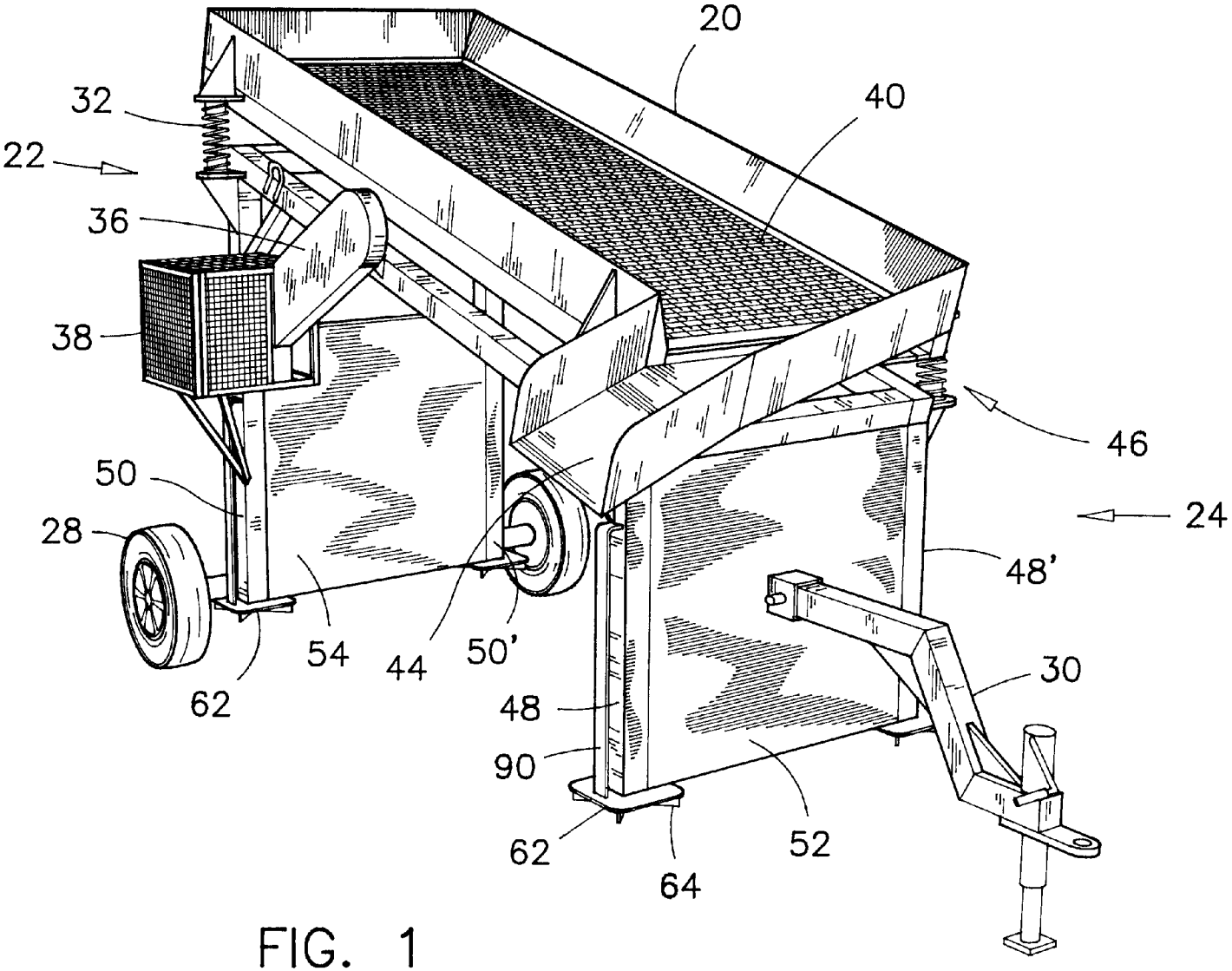
FIG. 1 is a perspective front, top and left side view of the portable vibrating screen of the preferred embodiment.

The specified maximum capacity of the portable screen of the preferred embodiment illustrated and described herein is about one cubic yard. That is, batches of one cubic yard of gravel (2800 lbs.) may be dumped at once into the screening basket. However, a one cubic-yard loading bucket of a loader is seldom filled to full capacity. Therefore, for the design and other practical purposes, an actual normal load processed by the machine is defined as being 2000 lbs., or about 70% of the maximum specified capacity.

Referring particularly to FIGS. 1 to 6. The portable vibrating screen of the preferred embodiment has an arched frame supporting the screening basket 20. The arched frame has a tall end 22, a short end 24 and a pair of stringer members 26 joining the upper portions of the tall end 22 and the short end 24. The tall end 22 has a removable axle with wheels 28. The short end 24 has a removable hitch bar 30. The portable vibrating screen of the preferred embodiment is thereby transportable behind a vehicle.

The screening basket 20 is supported on the arched frame by four coil springs 32 and by an eccentric shaft assembly 34 mounted in an intermediate position along the stringer members 26 and the structure of the screening basket. The eccentric shaft assembly 34 is driven by a V-belt drive inside belt guard 36, and a gasoline engine mounted inside the enclosure 38. The portable vibrating screen of the preferred embodiment is thereby operable as a stand alone unit.

The preferred overall screen surface inside the screening basket 20 is 48" by 132". The screening basket 20 preferably has a coarse screen 40 superimposed over a fine screen 42 which is better seen in FIGS. 3 and 6.

The screening basket 20 is preferably set at an angle of about 18° to the horizontal plane for screening loam, peat moss and the like, and at 22° for screening sand and gravel.

The portable vibrating screen of the preferred embodiment further has a sideward chute 44 for deflecting the rejects from the coarse screen 40 toward one side of the machine. The rejects from the fine screen 42 are directed toward the short end 24 of the machine through an opening 46 above the fine screen 42 and directly below the sideward chute 44.

The tall end 22 and the short end 24 have each a pair of spaced apart leg members 48,48" and 50,50" respectively, and ballasts 52 and 54 incorporated between these leg members.

Each of the ballasts 52 and 54 is made of a concrete block enclosed between two respective leg members and two ⅛" steel plates spaced apart a thickness of a leg member. The total weight of the short end 24 of the arched frame comprising the ballast 52 and the leg members 48,48" is approximately 940 lbs. Similarly, the total weight of the tall end 22 of the arched frame is about 1060 lbs. Thus the total dampening mass of the vibrating screen of the preferred embodiment is about the same as a normal load processed on the machine.

This dampening mass has proven to be effective in stabilizing the vibrating screen in a variety of operating conditions. The mass is further reasonably sized such that portability of the machine is not compromised.

Each spring 32 is preferably a coil spring having an outside diameter of about 4", and a free height of about 14" comprising 9 turns of wire having a diameter of about ½". The springs 32 are made of spring steel and are preferably the same as used in the suspension of a North-American-built compact car. The springs 32 are attached between the screening basket 20 and the arched frame at a location where an axis of each spring is aligned with a respective leg member.

During installation of the four coil springs 32 and eccentric shaft assembly 34, the springs are compressed to a working height of about 12". The pre-stressing of the springs creates an upward pulling force on the eccentric shaft assembly 34 and on the stringer members 26. This initial pulling force causes the stringer members to deflect upwardly by a nominal sag.

The pre-stressing of the springs 32 is approximately equivalent in force to the weight of a normal load in the screening basket. Hence, when a normal load is actually contained inside the screening basket 20, the stringer members 26 are relatively straight and under minimum bending stresses.

Figure 2:
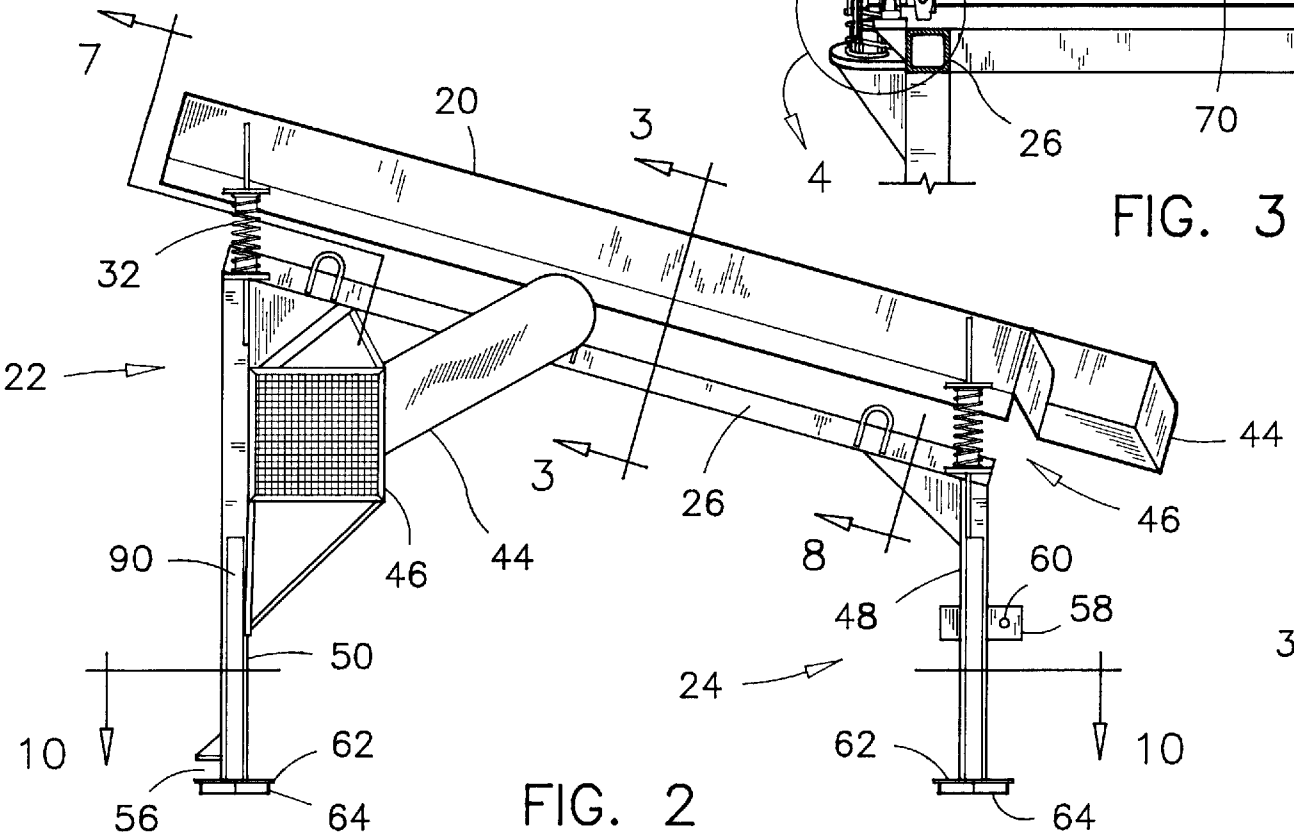
FIG. 2 is a left side view of the portable vibrating screen of the preferred embodiment.
Figure 6:
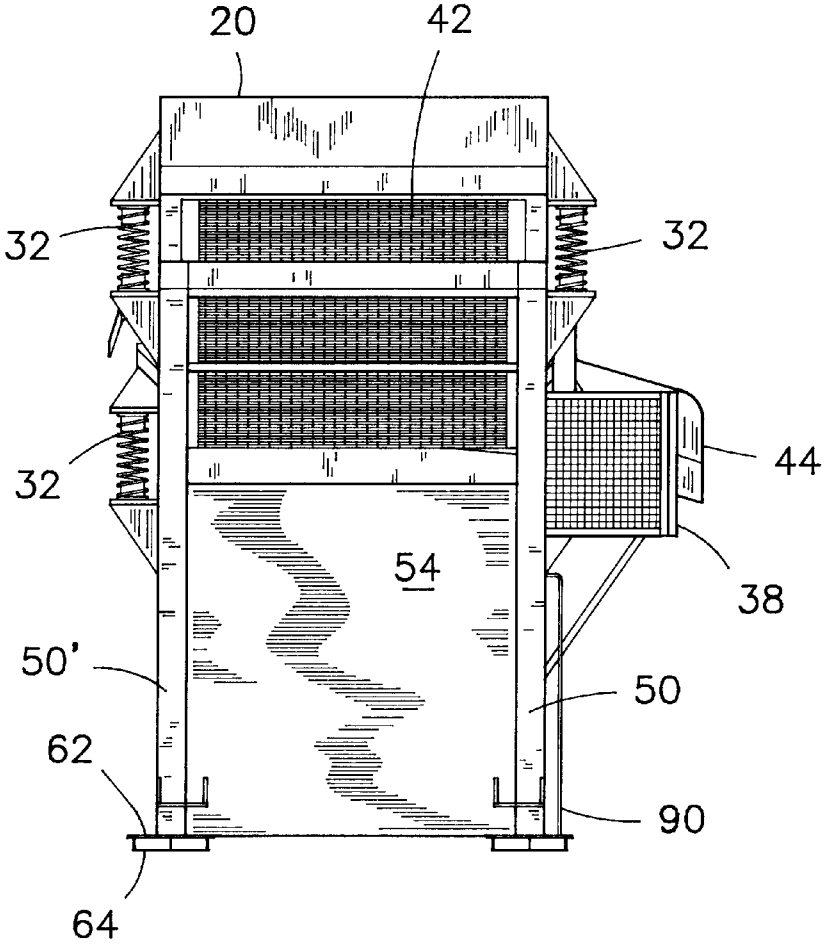
FIG. 6 is a rear view of the portable vibrating screen of the preferred embodiment.
Figure 5:
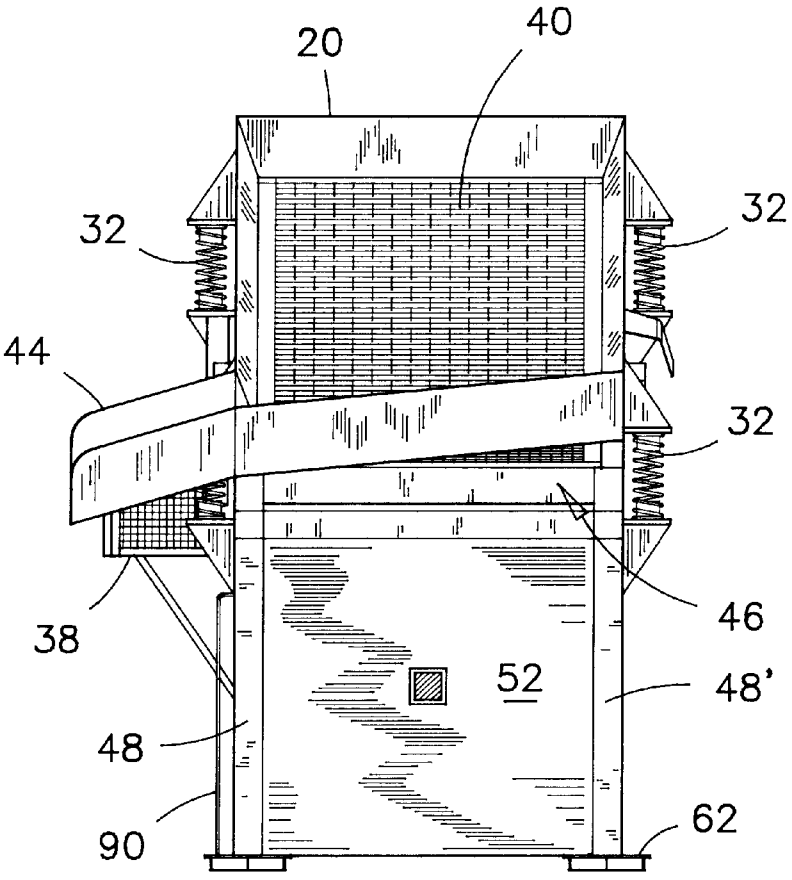
FIG. 5 is a front view of the portable vibrating screen of the preferred embodiment.

As is illustrated in FIG. 2, the axle and wheel assembly 28 are removably mounted on the tall end 22 of the arched frame into two pockets 56 and normally retained therein by bolts (not shown). Similarly, the hitch bar 30 is normally held into a tubular pocket 58 through the short end 24 by means of a pin (not shown) through hole 60. The axle and wheel assembly 28 and hitch bar 30 are removable such that the portable vibrating screen is install-able directly on the ground on four base plates 62. Each base plate 62 has on its lower surface, an X-shaped projection 64 for stabilizing the machine on sloped or irregular surfaces. This X-shaped projection 64 is also partly seen in FIG. 1.

Figure 3:
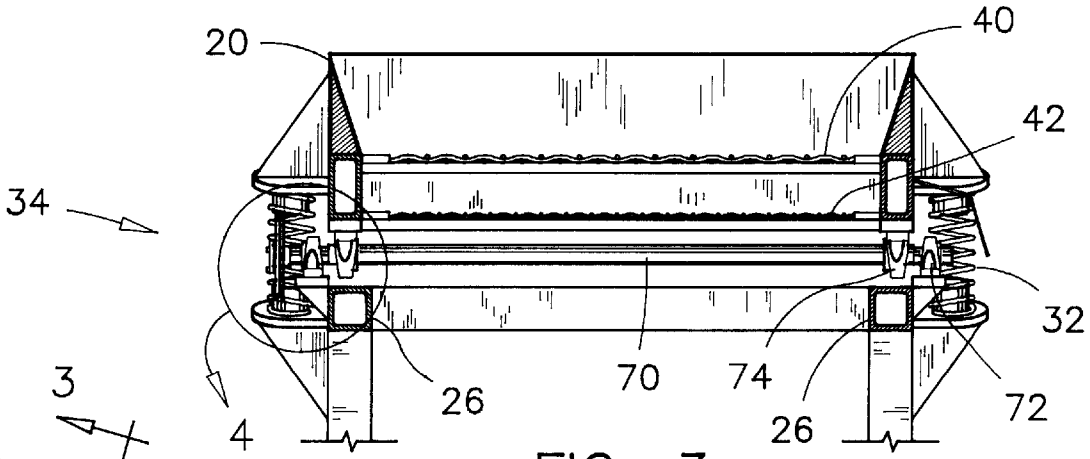
FIG. 3 is a cross-sectional view of the arched frame and basket of the portable vibrating screen across line 3—3 in FIG. 2.
Figure 4:
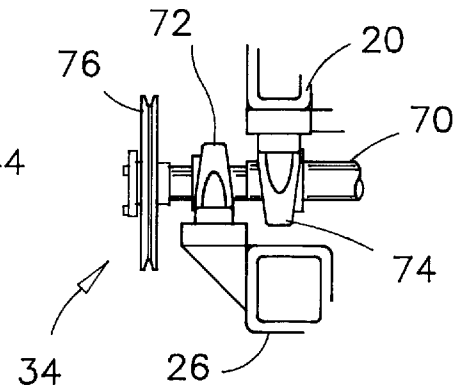
FIG. 4 is an enlarged view of Detail 4 in FIG. 3.

As is illustrated in FIGS. 3 and 4, the eccentric shaft assembly 34, comprises an offset shaft 70, a first pair of pillow block bearings 72 mounted on the upper side of the stringer members 26 and a second pair of pillow block bearings 74 mounted underneath the frame of the screening basket 20. The eccentric shaft assembly 34 is driven by a V-belt sheave 76. The total offset of shaft 70 is preferably between about ¼" to about ⅜" such that the total throw of the screening basket 20 is approximately ½" to ¾".

A preferred engine size for the portable vibrating screen of the preferred embodiment is about between 5½ and 6½ H.P. The preferred power transmission ratio of the V-belt drive is about between 5.6 and 6 to 1. Hence a rotational speed of the eccentric shaft assembly 34 is between 250 and 640 RPM when the engine speed is about between 1500 and 3600 RPM. The gasoline engine preferably has a transmission with a reverse rotation of the output shaft, for use when breaking and screening material containing cohesive lumps such as large sods for example.

Referring now to FIGS. 7, 8, 9 and 9A, there are illustrated therein the main features of the arched frame of the portable vibrating screen of the present invention. The screening basket 20 is held over the arched frame at six points of support; that is by two springs 32 along plane 'A', two springs 32 along plane 'B', and two pairs of bearings 72,74 along plane 'C'. The springs 32 along plane 'A' and plane 'B' are vertically aligned with ballasts 52 and 54 respectively, such that they do not apply any stresses on the stringer members 26.

The material and dimensions for the stringer members 26 are selected such that a maximum permissible deflection, without exceeding the elastic limit of the material, is at least slightly more than the offset of the eccentric shaft 70. On the other hand, the stringer members 26 are selected such they have sufficient stiffness to resist excessive sagging when the screening basket is loaded with a normal load.

In the actual design of the preferred embodiment, the stringer members 26 each have an unsupported length of about 100" measured at a midpoint on the upper edge of gusset 82, to a midpoint of the upper edge of gusset 80. A preferred material for the stringer members 26 is a hollow structural steel, 4"×4" having a wall thickness of 3/16". The material specification of this square tubing is ASTM A441-50W.

Accordingly, both stringer members 26 can sag a distance equal to the maximum offset of the offset shaft 70, (3/8"), when subjected to a loading in excess of 3 times the normal loading of the machine. This sag is still within an elastic limit of the material. The yield point of the stringer member 26 does not occur until a sagging of approximately 5/8".

The stringer members 26 of the preferred embodiment have sufficient elasticity to flex up and down a full distance 'D' equivalent to twice the offset of shaft 70. The stringer members 26 also have sufficient stiffness to resist excessive deflection thereof during normal operation of the machine. In fact, when a normal load is dumped into the screening basket, an initial deflection in stringer members 26 is less than 0.100" and decreases rapidly as material falls through the screens.

Therefore, when the screening basket 20 is subject to severe overloading, the eccentric shaft 70 continues to rotate with its motion entirely absorbed by a flexion 'D' of stringer members 26, while the basket remains relatively motionless. The motion of the basket resumes shortly thereafter when sufficient material has fallen through the screens and a normal loading level is reached. This feature of the vibrating screen of the preferred embodiment is an efficient overload protection against inevitable loading surges common with equipment of this type.

The connections at each end of the stringer members 26 are also somewhat flexible. The gusset member 80 for strengthening the connection of a stringer member 26 to the short end 24 is thinner than the width of the stringer member 26. During operation of the machine and a flexion of the stringer member 26, the lower wall of the stringer member 26 is thereby allowed to resiliently flex as shown by dashed line 84. Similarly, gusset member 82 is tinner than the width of the stringer member 26 for allowing some flexibility of the lower wall thereof. The semi-flexibility of these connections prevents the concentration of stresses known to cause fatigue cracking.

Furthermore, the arched frame does not have any cross-bracing between the lower end of the leg members. Both the tall end 22 and the short end 24 are thereby allowed to lean back and forth as shown by dimension 'E' and 'F' respectively, for following the deflection 'D' of the stringer members 26.

FIG. 9A is an analogous diagram of the vibrating screen of the preferred embodiment. The mass of the screening basket '$M_B$' is isolated from the auxiliary masses '$M_A$' of both ballasts 52 and 54 by coil springs 32,32'. The movement '$M_E$' of the eccentric shaft assembly 34 is also isolated from the ballasts 52 and 54 by means of a third isolator in the form of the aforesaid spring properties of the stringer members 26.

The portable vibrating screen of the preferred embodiment is thereby surprisingly stable on the ground when operating. It remains in place even when operating days at the same location. The machine is extremely resistant to fatigue cracking and failure. The vibrating screen of the preferred embodiment has proven to be extremely reliable and durable even when operated under rough loading such as when screening shale rocks and very coarse gravel.

Figure 10:
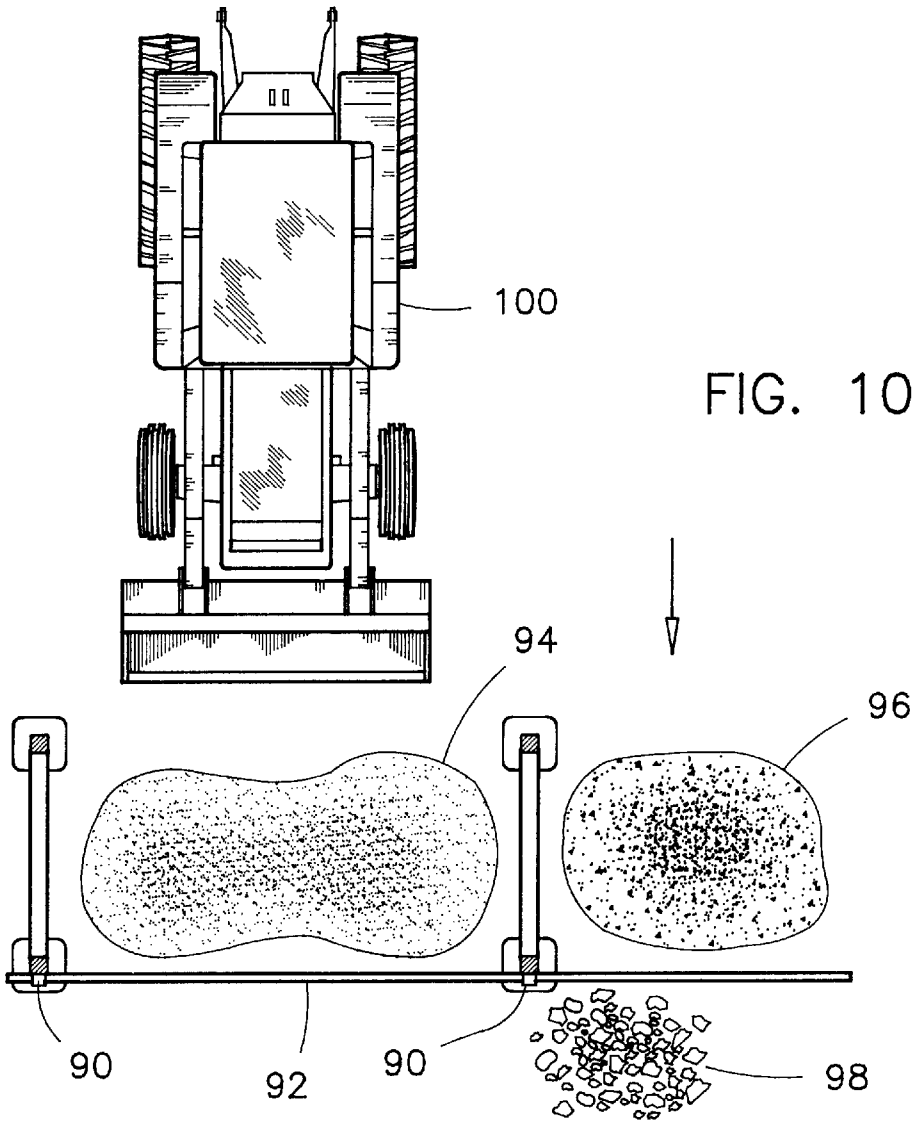
FIG. 10 illustrates a cross-sectional view of the portable vibrating screen along line 10—10 in FIG. 2, and a top view of a farm tractor working around the portable vibrating screen of the preferred embodiment.

Referring now to FIG. 10, the frame of the vibrating screen of the preferred embodiment has two strap members 90 spaced from and along the left side legs 48 and 50 of the machine. These strap members 90 are better illustrated in FIGS. 1, 5 and 6.

During use of the portable vibrating screen, several wood planks 92 are inserted behind the strap members 90 for defining regions on the ground under and around the machine. A first region 94 is thereby defined under the vibrating screen for containing the fine material passing through both the coarse and fine screens. A second region 96 at the front of the vibrating screen contains aggregate material passing through the coarse screen and sliding down over the fine screen. A third region 98 under the reject chute 44 receives the large rocks and other rejects from the coarse screen 40.

As mentioned earlier, the arched frame of the portable vibrating screen of the preferred embodiment does not have any cross-bracing along the ground between the short and tall ends. The defined regions 94 and 96 are thereby easily accessible from the right side of the machine, for example, by a farm tractor 100 for removal of the screened material.

Figure 11:
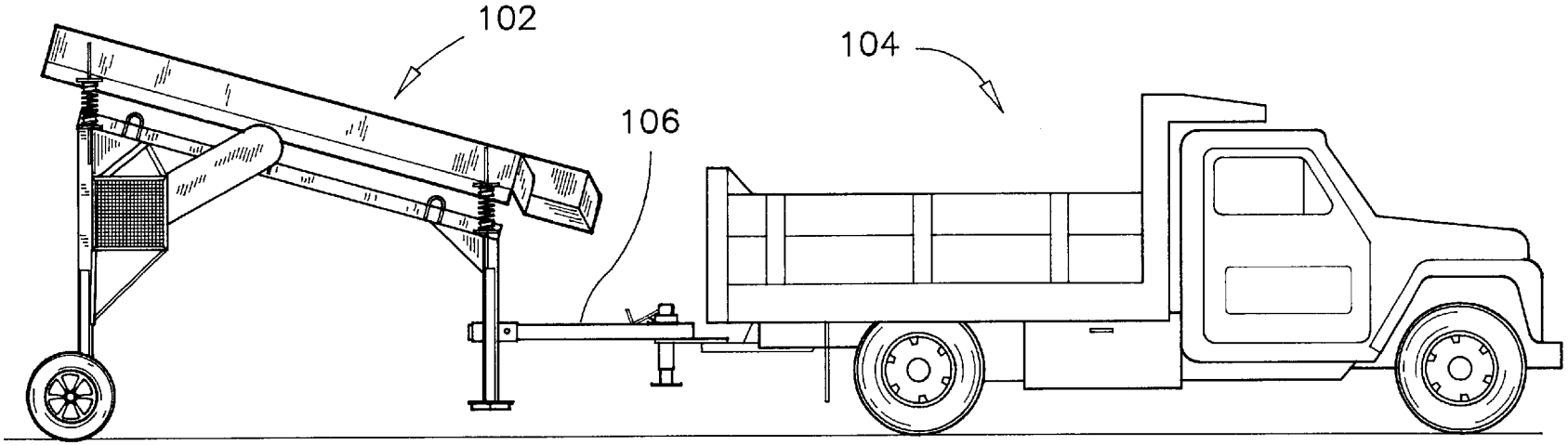
FIG. 11 is a side view of a first model of the portable vibrating screen of the preferred embodiment, hitched behind a one-ton truck.
Figure 12:
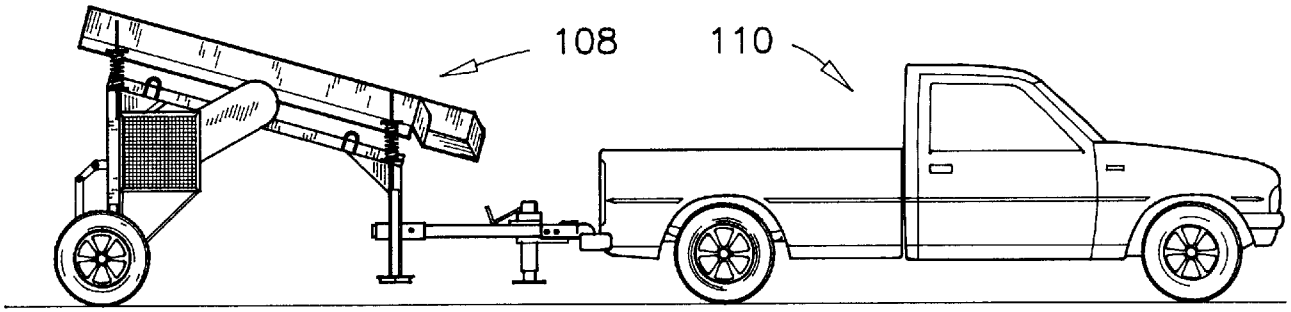
FIG. 12 is a side view of a second model of the portable vibrating screen of the preferred embodiment, hitched behind a quarter-ton truck.

Referring now to FIGS. 11 and 12, the portable vibrating screen of the preferred embodiment 102 is dimensioned to be transportable behind a 3/4-ton truck with a hitch bar 30 as illustrated in FIG. 1, and preferably behind a one-ton truck 104 with a straight hitch bar 106.

The dimensions and capacity of the portable vibrating screen of the preferred embodiment 102 are scaled down by about 75% in a second illustrated model 108 of the vibrating screen of the preferred embodiment. The smaller vibrating screen 108 is more appropriate for use by an equipment rental business for lease to homeowners and one-time landscapers for example. The small machine is transportable behind a car or preferably behind a small 1/4-ton pickup truck 110.

While the above description provides a full and complete disclosure of the preferred embodiment of this invention, various modifications, alternate constructions and equivalents may be employed without departing from the true spirit and scope of the invention. Such changes might involve alternate materials, components, structural arrangements, sizes, construction features or the like. Therefore, the above description and the illustrations should not be construed as limiting the scope of the invention which is defined by the appended claims.

I claim:

1. A vibrating screen for separating screenable material, comprising:

an arched frame having a vertical tall end, a vertical short end and two spaced apart stringer members joining upper portions of said tall end and said short end and defining an inclined plane between said tall end and said short end;

said tall end having a first pair of spaced apart leg members and a first ballast mounted between the leg members of said first pair;

said short end having a second pair of leg members and a second ballast mounted between the legs members of said second pair;

a basket being resiliently supported above and along said inclined plane, said basket having a perforated bottom surface and vertical sides for receiving a nominal load of screenable material therein;

an eccentric drive means attached to said basket for imparting a reciprocal movement to said basket; and power supply means mounted on said arched frame and connected to said eccentric drive means for actuating said eccentric drive means;

whereby during operation thereof, an amplitude of a vibration of said basket transmitted to said arched frame is largely absorbed by said first and second ballasts.

2. A vibrating screen as claimed in claim 1 wherein a normal load of screenable material in said basket is about the same as a total of a weight of said first ballast with a weight of said leg members in said first pair, plus a weight of said second ballast with a weight of said leg members in said second pair.

3. A vibrating screen as claimed in claim 1 wherein each of said first and said second ballasts is a rectangular slab of concrete enclosed in a region defined between said leg members of a pair from said first and second pairs, and having a thickness similar to a width of one of said leg members.

4. A vibrating screen as claimed in claim 3 wherein opposite vertical surfaces of said concrete slab between said leg members of a same said pair are lined by parallel steel plates.

5. A vibrating screen as claimed in claim 4 wherein said second ballast in said short end has a rectangular pocket therethrough for removably receiving a hitch bar.

6. A vibrating screen as claimed in claim 5 further comprising an axle with wheels removably mounted on a lower portion of said tall end, whereby said vibrating screen is transportable behind a vehicle.

7. A vibrating screen for separating screenable material, comprising:

an arched frame having a vertical tall end, a vertical short end and two spaced apart stringer members joining upper portions of said tall end and said short end, said stringer members defining an inclined plane between said tall end and said short end;

said tall end having a first pair of spaced apart leg members and a first ballast mounted between the leg members of said first pair;

said short end having a second pair of leg members and a second ballast mounted between the legs members of said second pair;

a basket having a rectangular frame, a perforated bottom surface and vertical sides for receiving a nominal load of screenable material;

a plurality of springs mounted atop said arched frame and connected to said rectangular frame for supporting said basket above said inclined plane;

an eccentric drive means attached to said rectangular frame and to said stringer members for retaining said basket along said inclined plane, and for imparting a reciprocal movement to said basket;

said eccentric drive means comprising a rotatable offset shaft;

said stringer members being flexible in an elastic region thereof a sag distance corresponding to at least an offset dimension of said offset shaft; and, power supply means mounted on said arched frame and connected to said eccentric drive means, for actuating said eccentric drive means;

whereby during an operation thereof, an amplitude of a vibration of said basket transmitted to said arched frame is largely absorbed by said plurality of springs and by said first and second ballasts, and is at least partly absorbed by a deflection of said stringer members.

8. A vibrating screen as claimed in claim 7 wherein said plurality of springs is four springs, and a minimum loading on all said springs is a force similar to the weight of said nominal load.

9. A vibrating screen as claimed in claim 8 wherein a material of said stringer members is selected such as said stringer members have a deflection of less than about 0.100" when said basket contains said nominal load.

10. A vibrating screen as claimed in claim 9, wherein said eccentric shaft has an offset of between about ¼" and about ⅜".

11. A vibrating screen as claimed in claim 10 wherein said stringer members are flexible a sag of about ⅜" when a loading on said stringer members is about 3 times said nominal load.

12. A vibrating screen as claimed in claim 11 wherein a yield strength in said material is reached when said stringer members are loaded and sagging a distance in excess of 0.625".

13. A vibrating screen as claimed in claim 9 wherein a connection of said stringer member to said tall end, and a connection of said stringer member to said short end comprises a gusset member which is thinner than a width of said stringer member.

14. A vibrating screen as claimed in claim 8 wherein each of said springs is aligned with one of said tall and short ends.

15. A vibrating screen as claimed in claim 7 wherein said basket comprises a coarse screen superimposing a fine screen, a reject chute communicating with a lower edge of said coarse screen and having a discharging end alongside said arched frame, and an opening between a lower edge of said coarse screen and a lower edge of said fine screens, for guiding a portion of said screenable material toward a region adjacent said lower edges.

16. A vibrating screen as claimed in claim 15 wherein said screenable material is gravel and said inclined plane makes an angle of about 22° with a horizontal line.

17. A vibrating screen as claimed in claim 15 wherein said screenable material is loam and said inclined plane makes an angle of about 18° with a horizontal line.

18. A vibrating screen as claimed in claim 7 wherein said nominal load of screenable material is 2000 lbs., and said stringer members are made of hollow structural steel 4"×4" having a wall thickness of 3/16" with mechanical properties as defined in ASTM A441-50W.

19. A vibrating screen as claimed in claim 7 further comprising slot means along said leg members on a same side of said arched frame for receiving and holding wood planks defining regions on the ground under and around said arched frame.

* * * * *